United States Patent [19]

Johnson

[11] 4,312,639

[45] Jan. 26, 1982

[54] PROCESS FOR HEATING SOLIDS FOR COAL GASIFICATION

[75] Inventor: Steven W. Johnson, Plano, Tex.

[73] Assignee: Atlantic Richfield Company, Los Angeles, Calif.

[21] Appl. No.: 219,127

[22] Filed: Dec. 22, 1980

[51] Int. Cl.[3] ..... C10J 3/12

[52] U.S. Cl. ..... 48/210; 48/202; 201/12

[58] Field of Search ..... 48/197 R, 202, 206, 48/210; 201/12, 16, 38

[56] References Cited

U.S. PATENT DOCUMENTS 1,977,684 10/1934 Lucke ..... 48/206

2,557,680 6/1951 O'Dell ..... 201/12

3,993,583 11/1976 Seglin ..... 48/206

4,157,245 8/1979 Mitchell et al. ..... 201/12

*Primary Examiner*—Peter F. Kratz

*Attorney, Agent, or Firm*—M. David Folzenlogen

[57] ABSTRACT

In a coal gasification system using hot recycled inert heat transfer medium solids, before the solids are heated and recycled back to a gasification reactor, the solids are separated from ash and unreacted char. The unreacted char is thereafter burned producing a hot flue gas. The hot flue gas and separated inert heat transfer solids are thereafter mixed to reheat the solids. Two alternate forms of multiple bed solids heating arrangements are described. One uses countercurrent slowly moving beds. The other uses countercurrent fluidized beds. The slow moving bed arrangement is preferred.

5 Claims, 2 Drawing Figures

PROCESS FOR HEATING SOLIDS FOR COAL GASIFICATION

BACKGROUND OF THE INVENTION

This invention generally relates to the gasification of coal with an inert heat transfer medium (IHTM). More particularly, this invention is concerned with improvements in the processing of the ash, char and IHTM remaining after the gasification of coal.

Coal may be gasified using steam and hot IHTM solids. The particular details of the coal gasification reaction form no part of this invention and a detailed description of this reaction is not required.

The coal gasification reaction produces a mixture of ash, unreacted char and IHTM. This mixture is generally fed to a fluidized combustor or lift pipe. In the lift pipe combustor, the unreacted char is burned and the heat of combustion reheats the IHTM in the mixture. The reheated IHTM is recycled back to the coal gasifier. This system for burning the unreacted char and reheating the IHTM has several shortcomings. For example, it is difficult to size a lift pipe system for complete combustion of the unreacted char. Char combustion temperatures may fuse the free ash and cause slugging and agglomeration of the ash and IHTM, and may cause depositions on the lift pipe walls which could change the operating characteristics of the lift pipe or plug it. The fluidizing lift gas is heavily laden with solids causing hydrodynamic instability and sensitivity to gas rates, gas to solids ratios, and particle sizes. Moreover, char combustion produces a hot dirty gas containing carbon monoxide which is difficult to handle. Fluidizing a mixture of ash, char, and IHTM also causes erosion problems.

It is an objective of this disclosure to provide a method of burning unreacted char and reheating IHTM in a way that lessens or overcomes the problems encountered in fludized ash, char, IHTM combustors, allows for the storing of heat energy, and provides better combustion of the unreacted char remaining after a coal gasification reaction.

SUMMARY OF THE INVENTION

In the process of this invention, ash and char are elutriated or separated from the IHTM solids. The separated char is then burned and the hot flue gas is used to reheat the IHTM solids. Separate handling of the char follows for better control over the combustion chamber and produces a cleaner gas with less carbon monoxide. Slagging of the ash would present no problem and would provide for positive ash rejection. In a preferred arrangement, the IHTM solids are reheated in a three stage countercurrent bed system. The beds may be moving beds or fluidized beds. The countercurrent multiple bed system increases heat transfer efficiency, reduces hydrodynamic problems and erosion, and allows for greater system fluctuations. Even if a lift pipe were used for the heat exchanger, the lift pipe could be designed solely around the inert medium solids without regard to char burning.

DETAILED DESCRIPTION OF THE INVENTION

Figures 1, 2:
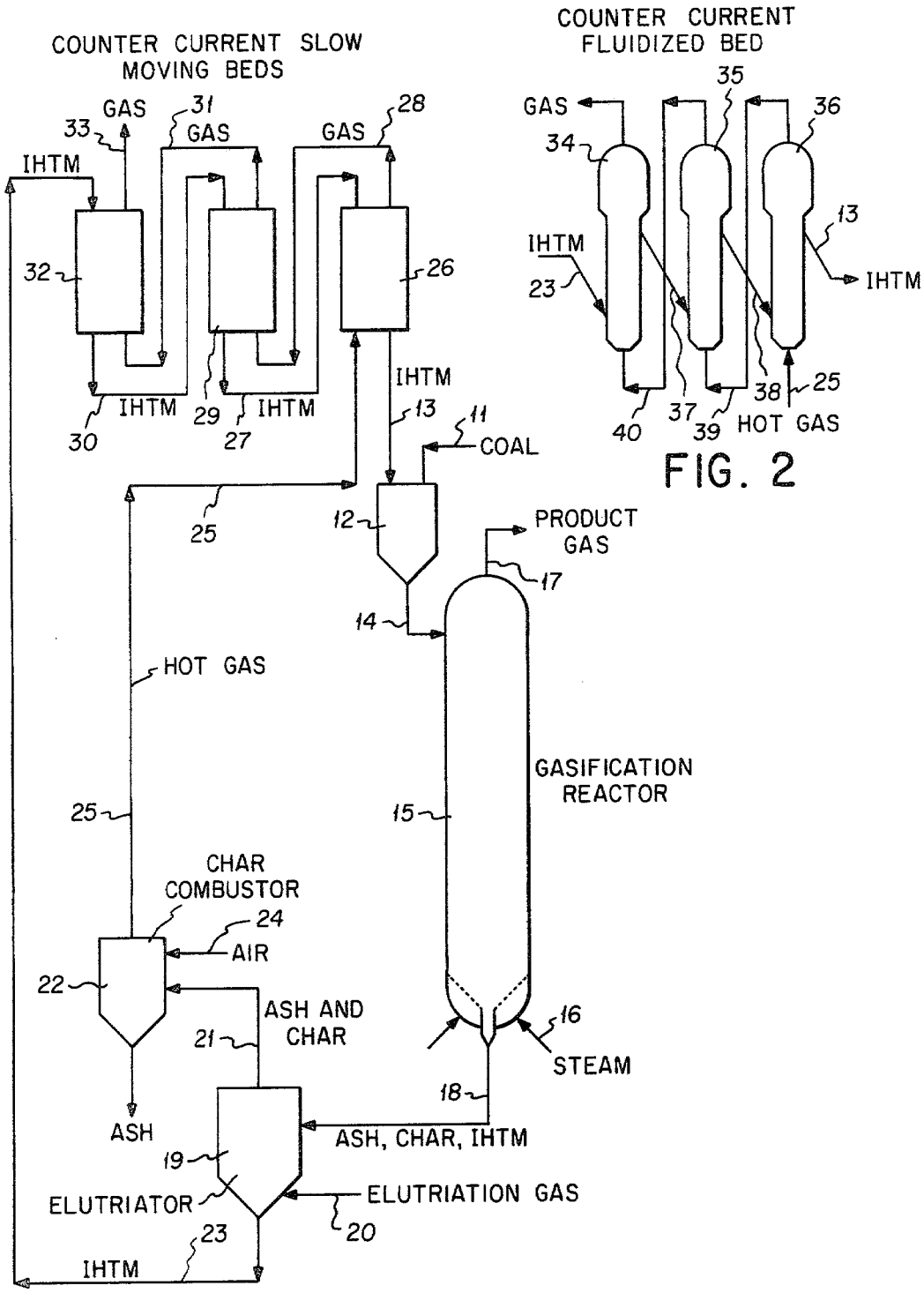
FIG. 1 is a partly schematical, partly diagrammatical flow illustration of a system for carrying out a preferred sequence of the process of this invention.
FIG. 2 is a partly schematical, partly diagrammatical illustration of an alternate sequence for heating IHTM solids.

A process for combusting char produced in the gasification of coal and for reheating IHTM solids used in the coal gasification reaction is described having reference to FIG. 1. Coal which has been mined and pulverized, crushed or ground to a predetermined suitable size is fed through coal inlet line 11 into suitable hopper of accumulator 12 where the coal is mixed with inert heat transfer medium (IHTM) fed by IHTM inlet line 13. The coal may have been subjected to prior treatment, for example, pryolysis to drive off hydrocarbons that are readily vaporized. The IHTM is comprised of subdivided or particulate bodies or solids which do not disintegrate, decompose, melt or fuse in the process, for example, sand. The IHTM is substantially hotter than the coal and is hot enough to provide heat to assist is gasifying coal, for example, greater than 1200° F.

A mixture of IHTM and particulate coal is fed via inlet line 14 into coal gasification reactor 15. At the same time, steam is fed into the reactor, for example, into the lower part of reactor by way of steam inlet line 16. The reaction product gases and vapors are removed through overhead line 17 and a mixture of ash, unreacted char and IHTM solids is removed through reactor exit line 18. The mixture of solids is passed to elutriator 19 into which a suitable elutriation gas is flowed by way of gas inlet line 20. In the elutriator, ash and char are separated from the IHTM solids and are carried out of the elutriator through overhead line 21 to char combustor 22. If desired, part of the ash may first be separated from the char solids. The internal operation and design of gas elutriators is well known and depends on the relative properties of the particles being separated, and on such factors as free board height, bed height, bed weight, gas type, gas velocity, column diameter and cross-sectional area, and transport disengaging height. Preferably, the elutriating gas will be a gas that will not cause the char to burn prematurely.

The IHTM solids settle to the bottom of elutriator 19 and are conducted by suitable means or gravity through IHTM exit line 23 to a heat exchanger that will be hereinafter described.

In char combustor 22, the unreacted char is burned to provide a heated gas for reheating the IHTM solids. A combusting supporting gas, for example, air, or a mixture of air and fuel gas generated in the overall process, or flue gas with the desired amount of free oxygen, or the like, which may or may not have been preheated to char ignition temperatures, is blown into the char combustor via air inlet line 24. Steam may also be used to control burning, if desired. The quantity of combusting supporting gas, e.g, about 10 to 15 pounds of air per pound of char, affects the amount of char burned and the heat generated by burning and in turn the temperature of the exit gas in hot gas line 25, for example, 1900° F. and greater. Other factors taken into consideration during burning of the char are the particle size, burner chamber size, residence burning time, desired outlet temperature, heat losses and heat inputs, feed rates and the like. Of course, part of the char could be removed and stored when system fluctuations call for storage. Similarly, additional fuel material or gases may be used to supplement the char if this is necessary. This separate handling and burning of the char allows control over the gas heating part of the process and the balancing of gas heating and flow rates with the mass flow the temperature of IHTM needed for the coal gasifier.

The hot gas in line 25 and the IHTM solids in line 23 are passed to a suitable heat exchange system where the heat in the hot gas is transferred to the IHTM solids. For example, the gas and IHTM may be mixed in a fluidized bed, or mixed cocurrently in a lift pipe, or mixed countercurrently in a slowly moving bed. Two preferred arrangements are shown in FIGS. 1 and 2.

In FIG. 1, hot gas in line 25 at a suitable temperature, for example 1900° F., is passed upwardly through third moving bed chamber 26. At the same time, IHTM solids are fed into the top of the third chamber through inlet line 27 and slowly move downward exiting through line 13 into hopper 12 and thence into the coal gasification reactor.

The partially cooled, hot gas is then passed through feed line 28 upwardly through second moving bed chamber 29. At the same time, IHTM solids are fed into the top of the second chamber through inlet line 30 and slowly move downward exiting through line 27 and passing into the top third chamber 26.

The partially cooled, hot gas is then passed from the second chamber through feed line 31 upwardly through first moving bed chamber 32. At the same time, IHTM solids in line 23 are fed into the top of first chamber and slowly move downward exiting through line 30 and passing into the top of second chamber 29.

The gas exiting the first chamber through line 33 may be used for any suitable purpose or simply vented. For example, the gas may be used as elutriation gas in elutriator 19, or if it still contains sufficient heat, for example 800° F., it may be used in a boiler or a turbine power generating system.

In FIG. 2, a similar IHTM three bed heating system is shown except that fluidized beds 34, 35 and 36 are used respectively in place of the first, second and third moving bed chambers, and the IHTM solids are fed into a lower part of the chamber by way of lines 23, 37 and 38 respectively and the IHTM solids are removed in typical fashion from an upper part of the bed. The hot fludizing gas flows in the same fashion as before through lines 25, 39 and 40 respectively.

Reasonable variations and modifications are practical within the scope of this disclosure and without departing from the spirit and scope of the claims of this invention.

I claim:

1. In a method for the gasification of coal in a gasification reactor using hot inert heat transfer medium solids, which method includes removing a mixture of solids comprising ash, unreacted char and inert transfer medium from said gasification reactor and the char is burned to supply heat for heating the inert heat transfer medium solids, the improvements comprising:

(a) separating at least a portion of the ash and unreacted char in said removed mixture from the inert heat transfer medium solids in said removed mixture, (b) burning the separated char in a combustion vessel thereby producing a hot gas, (c) mixing said hot gas outside said combustor vessel with the separated inert heat transfer medium solids, thereby heating said inert heat transfer medium solids wherein said hot gas and heat transfer medium solids are mixed by passing said hot gas and heat transfer medium solids countercurrently through at least one mixing chamber, and (d) passing the heated inert heat transfer medium solids produced in step (c) to said coal gasification reactor.

2. The method of claim 1 wherein in step (a) the ash and char are separated by passing said mixture of solids to a gas elutriator and flowing an elutriation gas through said mixture of solids at a rate sufficient to lift ash and char out of said elutriator.

3. The method of claims 1 and 2 wherein the step (c) the hot gas and heat transfer medium solids are mixed by passing said heat transfer medium solids in one direction consecutively through at least two mixing chambers and by passing the hot gas in an opposite direction consectively through said chambers in a reverse order.

4. The method of claim 3 wherein the heat transfer medium is passed into the upper part of a first chamber, is removed from a lower part of said first chamber and passed into the upper part of a second chamber, and is removed from a lower part of said second chamber; and the hot gas is passed into a lower part of said second chamber, is removed from an upper part of said second chamber and passed into the lower part of said first chamber, and is removed from an upper part of said first chamber.

5. The method of claim 3 wherein the heat transfer medium is passed into a lower part of a first chamber, is removed from an upper part of said first chamber and passed into a lower part of a second chamber, and is removed from an upper part of said second chamber; and the hot gas is passed into a lower part of said second chamber, is removed from an upper part of said second chamber and passed into the lower part of said first chamber, and is removed from an upper part of said first chamber.

* * * * *